US005983050A

United States Patent [19]

Takekoshi et al.

[11] Patent Number: 5,983,050

[45] Date of Patent: Nov. 9, 1999

[54] IMAGE FORMING APPARATUS WITH VARIABLE CAPACITY CLEANING MEANS

[75] Inventors: Rie Takekoshi; Nobuhiko Takekoshi, both of Kawasaki, Japan

[73] Assignee: Canon Kabushiki Kaisha, Tokyo, Japan

[21] Appl. No.: 08/786,731

[22] Filed: Jan. 27, 1997

[30] Foreign Application Priority Data

Jan. 31, 1996 [JP] Japan ..... 8-037314

[51] Int. Cl.[6] ..... G03G 21/00; G03G 15/16

[52] U.S. Cl. ..... 399/71; 15/256.53; 399/349; 399/352; 399/353

[58] Field of Search ..... 399/71, 98, 99, 399/67, 68, 352, 353, 379, 396; 15/256.5–53

[56] References Cited

U.S. PATENT DOCUMENTS

| | | | |
|---|---|---|---|
| 4,549,803 | 10/1985 | Ohno et al. | 399/45 |
| 4,557,588 | 12/1985 | Tomosada | 399/352 |
| 5,138,392 | 8/1992 | Kinoshita et al. | 399/45 |
| 5,220,391 | 6/1993 | Tange | 399/349 |
| 5,486,903 | 1/1996 | Kanno et al. | 399/45 |
| 5,506,669 | 4/1996 | Inoue et al. | 399/71 |

FOREIGN PATENT DOCUMENTS

| | | |
|---|---|---|
| 58-199374 | 11/1983 | Japan . |
| 7-36328 | 2/1995 | Japan . |
| 7-49646 | 2/1995 | Japan . |

*Primary Examiner*—Arthur T. Grimley
*Assistant Examiner*—Quana Grainger
*Attorney, Agent, or Firm*—Fitzpatrick, Cella, Harper & Scinto

[57] ABSTRACT

An image forming apparatus includes: an image carrying member for carrying an image; a recording material carrying member for carrying a recording material; a transfer device for transferring the image from the image carrying member to the recording material carried by the recording material carrying member; and a cleaning device for cleaning the recording material carrying member, wherein, when images are formed successively on a plurality of recording materials, the cleaning capacity of this cleaning device is made larger as a distance between the rear end of a recording material and the forward end of the next recording material becomes larger.

17 Claims, 5 Drawing Sheets

IMAGE FORMING APPARATUS WITH VARIABLE CAPACITY CLEANING MEANS

BACKGROUND OF THE INVENTION

1. Field of the Invention

The present invention relates to an electrophotographic image forming apparatus, such as a copying apparatus, a laser beam printer or a facsimile apparatus and, in particular, to a cleaning means to be used in such an image forming apparatus.

2. Description of the Related Art

Conventionally, there have been proposed various image forming apparatuses which are equipped with a plurality of image forming sections and in which toner images of different colors are formed in the image forming sections, the toner images being sequentially superimposed one upon the other on the same recording material to thereby provide a color image.

In such a color image forming apparatus, foreign matter such as toner, lubricant oil or dust is usually allowed to adhere to the image carrier for carrying toner images formed thereon, the recording material carrying member for carrying the recording material and guiding it to the transfer section where image transfer from the image carrier is effected, etc. Such foreign matter, which may contaminate the recording material, must be removed by cleaning.

When the image forming speed of the image forming apparatus is relatively high, or when the amount of lubricant oil is increased as a result, for example, of using a sharp melt type toner, which is described below, a higher level of cleaning performance is required.

An electrophotographic multi-color copying machine of the type which uses an endless recording material carrying member is in use for high-speed recording.

In such an image forming apparatus, the recording material, which is carried by a feeding belt constituting the recording material carrying member, is conveyed to the transfer position of each of a plurality of image carriers (photosensitive drums). Then, cyan, magenta, yellow and black toner images are transferred one by one from the respective image carriers to the recording material carried by the feeding belt. After the image transfer has been completed, the recording material is conveyed to a fuser, where the toners of these colors are melted and mixed with each other, whereby a full-color toner image is fixed to the recording material. The fuser is equipped with a fixing roller which is held in contact with the unfixed toner image on the recording material, and a pressurizing roller which is in contact with the other side of the recording material. A lubricant such as silicone oil is applied to the fixing roller in order to prevent toner from adhering thereto.

After the completion of image transfer, the portion of toner remaining on the feeding belt and any foreign matter thereon are removed by cleaning by using a cleaning member which is brought into contact with the surface of the feeding belt.

However, the above construction has a problem in that the portion of the feeding belt where there is no recording material is subject to contamination with toner during the image transfer process. For example, some of the toner on the photosensitive drum may be scattered on this portion due to pretransfer discharge, which occurs immediately before the transfer position, or some of the unfixed toner transferred to the recording material may be scattered on this portion of the belt at the time of separation from the photosensitive drum. Further, fog toner on the photosensitive drum may be transferred to the belt, or toner may be allowed to drop directly onto it from the developing device or the cleaner for the photosensitive drum.

A cleaning member for removing toner adhering to the conveying belt, for example, a cleaning web (made of a nonwoven fabric) is attached to the surface of the conveying belt. As compared with the case in which copying is performed on a single sheet, the case in which copying is successively performed on a plurality of sheets has a problem in that a large amount of toner is allowed to remain on the belt in a short time. The amount of toner remaining on the belt depends upon the number of sheets on which copying is performed. Thus, in the latter case, an improvement in cleaning performance is required.

Further, in high-speed apparatuses, full-color apparatuses or the like, when the high voltage for image transfer is applied to the transfer charger even during inter-sheets periods (time intervals between sheets in the case of successive copying) in order to simplify the control sequence, the fog toner on the photosensitive drum is easily allowed to be transferred.

Further, to maintain satisfactory fixing conditions, when the thickness of the recording material is large, the fixing speed is decreased as compared to the usual case and, at the same time, the intervals between sheets in successive copying is enlarged. Further, due to the difference in size of the recording material, for example, the difference in size between an A4 size paper and a post card, a difference is generated in terms of the toner contamination of the feeding belt (as a result of scattering of unfixed toner images on the recording material) in the thrust direction thereof (the direction which is perpendicular to the direction in which the belt runs).

Further, in a both-side type machine which is capable of forming images on both sides of a recording material, the oil adhering to the recording material during the fixing on the first surface of the recording material is allowed to be transferred to the feeding belt during the image transfer on the second surface of the recording material. Since the oil easily comes into close contact with the remaining toner on the feeding belt, it is difficult to remove the oil and toner by cleaning. According to a measure for preventing this oil from being transferred to the photosensitive drum, the photosensitive drum is constantly coated with toner, which toner functions as a spacer between the photosensitive drum and the feeding belt. However, this results in the amount of toner transferred to the feeding belt being increased accordingly.

When the next recording material is attracted to the feeding belt without having clearing away such residual toner contamination on the feeding belt, the residual toner is transferred to the back side of the recording material and fixed thereto. Accordingly, a backside of the copy image whose back side becomes contaminated. This problem has not been solved yet. In an apparatus having a both-side copying function, image formation is also performed on the back side of the recording material, which is contaminated with the residual toner, with the result that the images formed on the first and second sides are both defective images contaminated with residual toner.

SUMMARY OF THE INVENTION

It is an object of the present invention to provide an image forming apparatus which is capable of satisfactorily clearing away contamination of the recording material carrying member due to scattered toner, fog toner, etc. regardless of the degree of contamination.

Further objects and features of the present invention will become more apparent from the following detailed description with reference to the accompanying drawings.

DESCRIPTION OF THE PREFERRED EMBODIMENTS

Embodiments of the image forming apparatus of the present invention will now be described with reference to the drawings.

Figure 3:
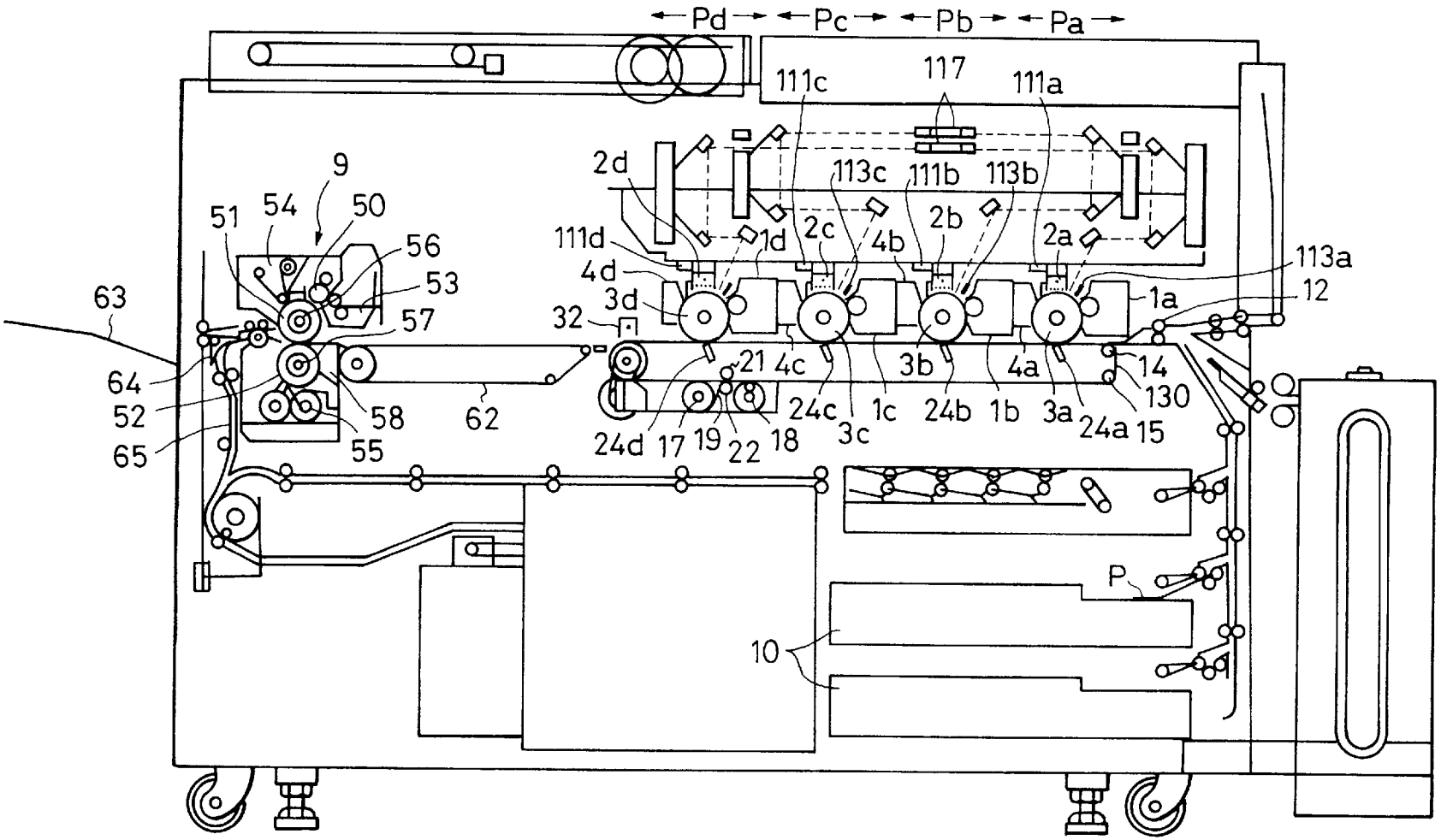
FIG. 3 is a schematic diagram showing the construction of an example of an image forming apparatus.

As an image forming apparatus, an example of a color electrophotographic recording apparatus will be described with reference to FIG. 3. In the apparatus, a first, a second, a third and a fourth image forming sections Pa, Pb, Pc and Pd are arranged side by side. In these image forming sections, toner images of different colors are formed by the steps of latent image formation, development and transfer.

The first through fourth image forming sections Pa through Pd are equipped with dedicated image carrying members, which, in this example, are electrophotographic photosensitive drums 3*a,* 3*b,* 3*c* and 3*d.* The toner images of different colors are formed on the photosensitive drums 3*a* through 3*d.* A recording material carrying member 130 (feeding belt) is provided adjacent to the photosensitive drums 3*a* through 3*d,* and the toner images of different colors formed on the photosensitive drums 3*a* through 3*d* are transferred to a recording material P carried and fed by the feeding belt 130. Further, the recording material P, to which the toner images of different colors have been transferred, undergoes the fixing of the toner images in a fixing section 9 by heating and pressurizing. After this, the image is discharged out of the apparatus as the recording image.

In the periphery of the photosensitive drums 3*a* through 3*d,* there are provided exposure lamps 111*a,* 111*b,* 111*c* and 111*d,* drum chargers 2*a,* 2*b,* 2*c* and 2*d,* electric potential sensors 113*a,* 113*b,* 113*c* and 113*d,* developing devices 1*a,* 1*b,* 1*c* and 1*d,* brush-type transfer chargers 24*a,* 24*b,* 24*c* and 24*d,* and cleaners 4*a,* 4*b,* 4*c* and 4*d,* respectively. Further, in the upper section of the apparatus, a light source device (not shown) and a polygon mirror 117 are provided.

Scanning is performed with a laser beam emitted from the light source device by rotating the polygon mirror 117. The scanning beam is deflected by a reflection mirror, and condensed on the generatrix of the photosensitive drums 3*a* through 3*d* for exposure, thereby forming latent images in accordance with an image signal on the photosensitive drums 3*a* through 3*d.*

The developing devices 1*a* through 1*d* are filled with a predetermined amount of toners of cyan, magenta, yellow and black, respectively, which are supplied as the developer by supplying devices (not shown). The developing devices 1*a* through 1*d* develop the latent images on the photosensitive drums 3*a* through 3*d* to visualize the cyan toner image, the magenta toner image, the yellow toner image and the black toner image.

The recording materials P are accommodated in a recording material cassette 10, from which they are supplied to the feeding belt 130 by way of a plurality of feeding rollers and resist rollers 12, and are successively supplied to transfer sections opposed to the photosensitive drums 3*a* through 3*d* by being fed by the feeding belt 130.

The feeding belt 130 consists of a dielectric resin sheet such as a polyethylene terephthalate resin sheet (PET sheet), a polyvinylidene fluoride resin sheet, or a polyurethane resin sheet. The ends of the belt are superimposed one upon the other and joined to each other to form an endless belt. Alternatively, a belt having no seam (seamless belt) may be used.

When this feeding belt 130 rotates until it is made sure that it is at a predetermined position, the recording material P is fed to the feeding belt 130 from the resist rollers 12, and the recording material P is fed to the transfer section of the first image forming section Pa. At the same time, an image writing signal is turned ON, and using this as a reference, image formation is performed on the photosensitive drum 3*a* of the first image forming section Pa with a predetermined timing. In the transfer section underneath the photosensitive drum 3*a,* the brush transfer charger 24*a* imparts an electric field or a charge, whereby the toner image of the first color formed on the photosensitive drum 3*a* is transferred to the recording material P. By this transfer process, the recording material P is firmly held by the feeding belt 130 by electrostatic attraction, and fed to the second image forming section Pb, etc.

Image formation and transfer are similarly conducted in the second through fourth image forming sections Pb through Pd. Then, the recording material P, to which the toner images of four colors have been transferred, undergoes charge removal by a separation charger 32 on the downstream side with respect to the feeding direction of the feeding belt 130 to thereby attenuate the electrostatic attracting force, whereby it is separated from the end portion of the feeding belt 130. The separated recording material P is conveyed to the fuser 9 by a conveying section 62.

The fixing device 9 comprises a fixing roller 51, a pressurizing roller 52, heat-resistant cleaning members 54 and 55 for cleaning each of them, roller heating heaters 56 and 57 installed in the rollers 51 and 52, an application roller 50 for applying lubricant oil such as dimethyl silicone oil to the fixing roller 51, an oil sump 53 for the oil, and a thermistor 58 for detecting the surface temperature of the pressurizing roller 52 to control the fixing temperature.

By the fixing operation, the toner images of four colors transferred to the recording material P are mixed together and fixed to the recording material P to thereby form a full-color copy image.

The color toners are required to exhibit a satisfactory melting property and mixing property when heated in the fixing device 9. When their melting property and mixing property are insufficient, the amount of air gaps between toner particles increases, with the result that the proper tones of the pigments are impaired through the scattering light at the interface between the toner and the air. Further, where toners are superimposed one upon the other, the lower toner is covered up by the upper toner, resulting in a deterioration in color reproducibility. As a toner satisfying such requirement in terms of melting property and mixing property, a so-called sharp melt type toner, which has a low softening point and a low melting viscosity is used. By using such a sharp melt type toner, an improvement is achieved in terms of color reproducibility, thereby making it possible to obtain a color copy faithful to the original.

However, the sharp melt type toner has a problem in that it has a great affinity, so that it easily causes offset to the roller 51 of the fixing device 9. In the fixing device, pressurization is effected in addition to heating. A toner which has a great affinity is liable to be transferred and adhere to the fixing roller as a result of the pressurization and the heating. This toner will adhere to the next recording material or set on the fixing roller, resulting in an defective image.

A lubricant oil such as dimethyl silicone is used for the purpose of preventing the generation of such a defective image. Prior to the fixing of the toner image to the recording material, the lubricant oil is applied to the fixing roller. Due to this arrangement, when the recording material to which the toner image has been transferred undergoes heating and pressurization, the fixing roller is brought into contact with the toner image through the intermediation of the lubricant oil, which means there is no direct contact between them, thereby effectively preventing toner from adhering to the fixing roller.

When the image transfer has been completed, the toner remaining on the photosensitive drums 3*a* through 3*d* is removed by the cleaning blades of the respective cleaners 4*a* through 4*d,* and the photosensitive drums are made ready for the next latent image formation process, etc. The toner portion remaining on the feeding belt 130 and any foreign matter thereon are wiped off by bringing the cleaning web 19 (non-woven fabric) into contact with the surface of the feeding belt 130.

A pair of rollers 17 and 18 are provided below the downstream end of the feeding belt 130. The cleaning web 19 is wound around one of these rollers, the web roller 18, from which it is fed, and is taken up by the other roller 17. Between the rollers 17 and 18, there is provided a pressurizing roller 22, by means of which the cleaning web 19 is pressed against the surface of the feeding belt 130. The pressing of the cleaning web 19 against the feeding belt 130 by the pressurizing roller 22 is backed up by an opposite roller 21 arranged on the back (inner) side of the feeding belt 130.

As preferable fibers for the cleaning web 19, it is possible to use fibers such as polypropylene, rayon, acryl, nylon, polyester, or vinylon or a fiber consisting of a mixture of these fibers.

In this image forming apparatus, it is possible to switch between a one-side copy mode in which image formation is effected only on one side of the recording material and a both-side copy mode in which image formation is effected on both sides of the recording material. When the both-side copy mode is selected by the user, and both-side image formation is to be effected on the recording material P, the recording material P is not conveyed to a paper discharge tray 63 after the transfer to one side has been completed and the recording material has passed the fixing device 9 but is conveyed to a feeding path 65 to be exclusively used for both-side image formation by a flapper (reversing member) 64 or the like. Then, the recording material P is reversed upside down and the feeding belt 130 is run again to perform image formation again on the surface (second surface) of that side of the recording material which is opposite to the surface (first surface) of the side on which image formation has been completed. At this time, there is a fear the lubricant oil adhering to the first side of the recording material P and, in particular, to the toner image thereon, will adhere to the surface of the feeding belt 130. Further, there is a fear that the oil from the feeding belt 130 transferred to the photosensitive drums 3*a* through 3*d* will adhere thereto and contaminate photosensitive drums 3*a* through 3*d.*

Since the cleaning blades of the cleaners 4*a* through 4*d* for the photosensitive drums 3*a* through 3*d* are mainly provided for the purpose of removing toner on these photosensitive drums, it is difficult to sufficiently remove the lubricant oil adhering thereto. As a result, there arises the problem of a defective image due to lubricant oil contamination of the photosensitive drums, which is a problem peculiar to both-side color copying (image formation). In view of this, the cleaning web 19, which is a cleaning member for cleaning the feeding belt 130, removes not only the residual toner on the surface of the feeding belt 130 but also the lubricant oil adhering to the surface.

FIRST EMBODIMENT

A first embodiment of the present invention will be described with reference to FIG. 1, which is an enlarged view of a part of the apparatus shown in FIG. 3. The components which are the same as those described above will be indicated by the same reference numerals and characters.

Figure 1:
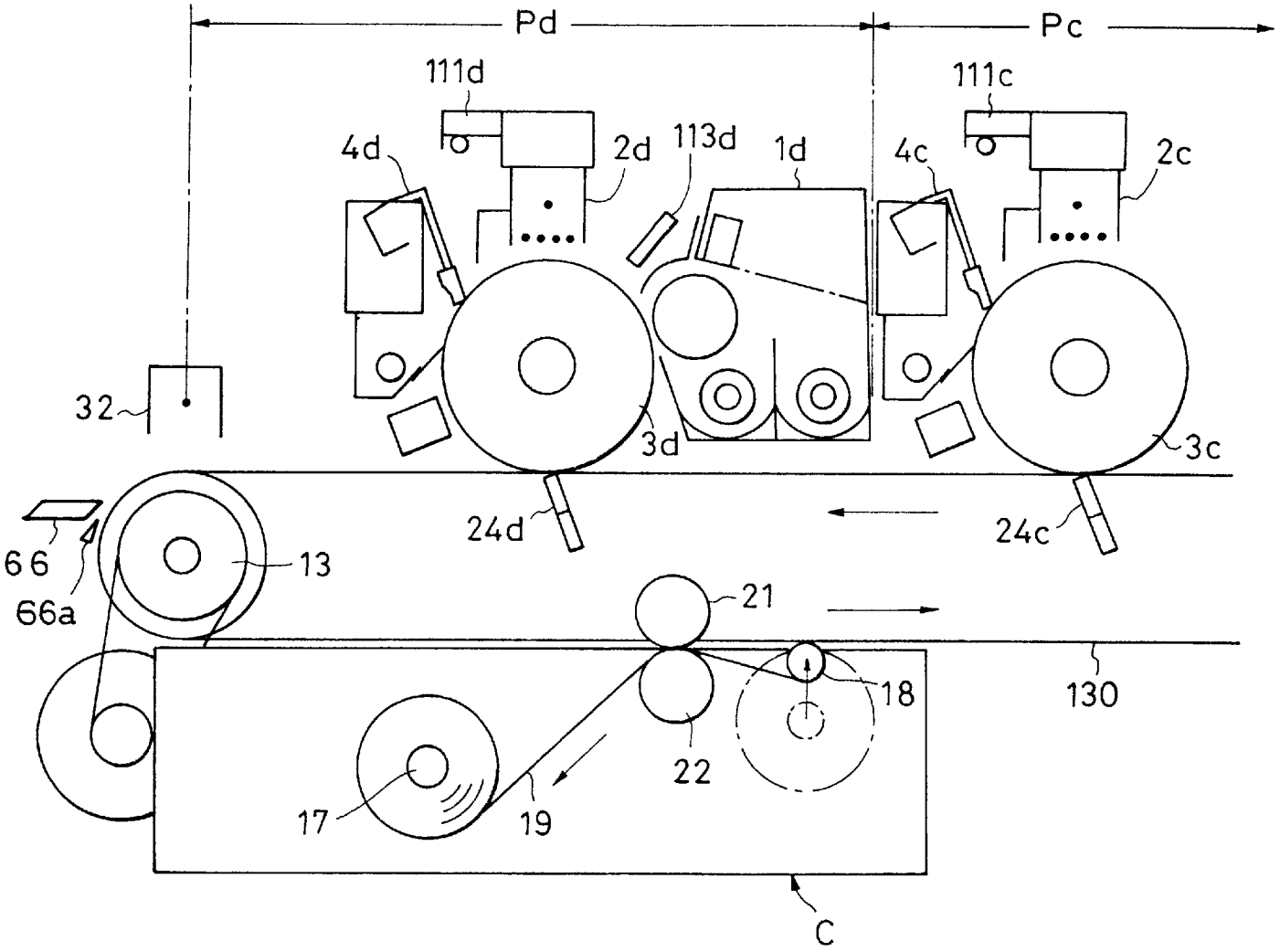
FIG. 1 is a schematic diagram showing the construction of a feeding belt cleaning unit.

The cleaning unit C serving as the cleaning means for the feeding belt shown in FIG. 1 is arranged below the fourth image forming section Pd which is at the downstream side end with respect to the recording material conveying direction and below the portion where the movement toward the upstream side with respect to the recording material conveying direction is started. It is equipped with a web roller 18 for a cleaning web serving as the cleaning member, a take-up roller 17, and pressurizing rollers 21 and 22 which are arranged between the rollers 18 and 17 and which press the cleaning web 19 against the lower surface of the feeding belt 130.

In the above-described construction, the remaining toner on that surface of the feeding belt 130, moving upstream with respect to the recording material feeding direction, which is in contact with the photosensitive drums 3*a* through 3*d* is wiped off by the cleaning web 19, the cleaning web 19 and the feeding belt 130 being held between and pressurized by the pressurizing rollers 21 and 22.

In this embodiment, the feeding belt 130, which is an endless recording material carrying member, has a thickness of 150 $\mu$m, a width of 330 mm in the thrust direction perpendicular to the rotating direction, and a circumferential length of 1330 mm, and is rotated at a speed of 100 mm/sec. The feeding of the recording material P by the feeding belt 130 is effected in the direction of the fourth image forming section Pd from the first image forming section Pa.

That surface of the cleaning web, serving to remove the remaining toner on the feeding belt, which is in contact with the feeding belt has the above-mentioned remaining toner embedded between the cleaning web fibers, so that the take-up roller 17 is rotated by a motor (not shown) to take up the cleaning web 19 to thereby cause a different portion of the surface of the cleaning web 19 to come into contact with the feeding belt 130. That is, the cleaning web surface portion in contact with the feeding belt 130 is changed.

In an example, this change may be effected by taking up the cleaning web by a predetermined amount for a predetermined period or for a predetermined number of sheets on which copying is effected. For example, assuming that the amount taken up at one time is approximately 5 mm, as measured from the contact nip where the cleaning web 19 is held between the pressurizing rollers 21 and 22 and in contact with the feeding belt 130, the cleaning web is taken up for each 15-minute rotation of the feeding belt.

In the above control method, the feeding belt is satisfactorily cleaned in the case of a single sheet copying. However, when a plurality of A4 size sheets are successively copied, the amount of toner scattered on the feeding belt is much larger. For successive operations, the amount of scattered toner is several times the amount, as compared to the case of a single sheet copying, that is scattered over or transferred to the feeding belt. Accordingly, the scattered toner and fog toner remaining on the feeding sheet if not wiped off by the cleaning web is accumulated on the feeding belt in a short time. Thus, the back side of the next sheet for copying is contaminated with the remaining toner.

In view of this problem, in this embodiment, the setting in which the cleaning web is taken up by approximately 5 mm for each 15-minute rotation of the feeding belt is not adopted. Instead, in the case of successive copying on a plurality of recording materials, in the timing with which the cleaning web is reduced. This will be described below in detail.

As shown in FIG. 1, a separation guide 66 is provided for guiding the recording material separated from the feeding belt 130. This separation guide 66 is equipped with a separation jam sensor 66*a* for checking whether the separation of the recording material has been effected or not. This separation jam sensor 66*a* detects the period of time from the instant a recording material has passed it to the instant the passing of the next recording material starts. The detection result is supplied to a control unit (not shown) to be electrically processed as data. On the basis of such data, the motor of the take-up roller 17 is controlled by a processing device.

Table 1 shows inter-sheet distance, i.e. the distance the rear end of a recording material and the forward end of the next recording material on the conveying belt and the detection times of the above separation jam sensor in the case of successive copying by the apparatus of this embodiment for different recording material sizes. The successive copying is a mode of copying in which images are successively formed on a plurality of recording materials in response to a single image formation signal input from outside. In successive copying, a plurality of recording materials are simultaneously carried by the feeding belt.

TABLE 1

| Size | Measured amount ($g/m^2$) | Inter-sheet distance detection time (sec.) |
|---|---|---|
| A4 | 80 | 0.30 |
| A4 | 200 | 7.90 |
| A4R (lengthwise feed) | 80 | 0.38 |
| A3 | 80 | 0.80 |
| A4 (OHP) | | 7.90 |
| A4 (second side) | 80 | 0.75 |

As shown in Table 1, when an A4 size thick paper sheet (200 $g/m^2$) or an OHP transparent resin film is used, the inter-sheet distance is relatively large as compared to the lateral feed (a manner of feeding in which the shorter side of an A4 size sheet is matched with the feeding direction) of an ordinarily A4 size sheet (80 $g/m^2$) in order to lower the fixing speed. Further, the inter-sheet distance is made relatively large in the second side of A4 size in order that the fixing speed is lower in the fixing of the second side of the A4 size recording material than in that of the first side of the A4 size.

The necessity of switching the cleaning capacity in accordance with the inter-sheet distance, which is the problem to be overcome by the present invention, is shown in Table 1. To effect a satisfactory fixing of the recording material, the requisite heat amount is obtained by changing the fixing speed, so that setting is effected such that the timing with which the recording material is fed (inter-sheet distance time) varies. Accordingly, the inter-sheet distance varies, and the amount of toner scattered on the feeding belt and the amount of fog toner vary with the inter-sheet distance.

Table 1 shows only some types of recording materials. In order that the apparatus may be used for all types of recording materials, the inter-sheet distance detection times detected by the above-mentioned separation jam sensor are classified in the processing device into five ranks as shown in Table 2.

TABLE 2

| Rank | Inter-sheet distance detection time (sec.) | Control | Output timing |
|---|---|---|---|
| Ref | (single sheet) | Ref | per 15 min. |
| A | 0 ~ 0.5 | Ref × 0.9 | per 13.5 min. |
| B | 0.5 ~ 1.5 | Ref × 0.8 | per 12 min. |
| C | 1.5 ~ 5.0 | Ref × 0.7 | per 10.5 min. |
| D | 5.0~ | Ref × 0.6 | per 9 min. |

In Table 2, the case in which a single recording material is used for copying is used as the reference rank. Ranks A through D are cases in which successive copying is performed on a plurality of recording materials. Ranks differ according to the inter-sheet distance. Setting is made such that the larger the inter-sheet distance, the shorter the take-up timing for the cleaning web.

In the control shown in Table 2, the A4 size recording material of 80 $g/m^2$ shown in Table 1 is controlled in rank A, and the A4 size OHP film is controlled in rank D. In these cases, the cleaning web is taken up by approximately 5 mm per 13.5 minutes and 9 minutes, respectively. In this way, the contaminated surface portion is replaced by a clean surface portion.

Thus, it is not only always possible to clean the feeding belt in a satisfactory manner but also to effect control according to the expected amount of scattered toner and fog toner on the feeding belt, so that there is no need to forcibly change the surface portion of the cleaning web when it still has a sufficient cleaning capacity, thereby achieving a substantial improvement in terms of the service life of the web.

In recent image forming apparatuses in which high quality images are required, there is provided a mode in which the user can manually select the degree of glossiness of the image. In this mode, control is effected to change the fixing level of the un-fixed toner on the recording material by changing the fixing speed to thereby impart a variation in glossiness to the image. Thus, in this mode, the paper feed timing (inter-sheet distance) is different from that of the normal mode. In this way, it is effective as shown, for example, in Table 2, to vary the output timing for the cleaning web according to the glossiness mode selection.

SECOND EMBODIMENT

Next, a second embodiment of the present invention will be described. This embodiment is characterized in that the cleaning output is controlled in accordance not only with the inter-sheet distance but also with the recording material size.

This embodiment differs from the first embodiment in that the inter-sheet distance is fixed in A4 size ordinary paper (80 g/m$^2$) and A3 size ordinary paper (80 g/m$^2$). That is, even when the ranks shown in the first embodiment are the same, if the recording material size differs, there may be a great difference in the total of inter-sheet distances passing in a fixed period of time (for example, a period corresponding to one lap of the feeding belt), resulting in a difference in the amount of toner and fog toner on the feeding belt.

In the separation jam sensor of this embodiment, the total of periods in which the recording material passes in, for example, a minute, is detected, and the detected time is supplied to a processing device (not shown) to be electrically processed. On the basis of the data thus obtained, the motor of the take-up roller 17 is controlled by the processing device.

Table 3 shows how the control is effected. In this embodiment, the output timing for the cleaning web in the case of an A4 size ordinary paper (rank B) is shorter than that in the case of an A3 size ordinary paper (rank A). Further, as in the first embodiment, since the inter-sheet distance is larger in the case of an A4 size thick sheet (200 g/m$^2$) (rank D) or an A4 size OHP film (rank D) than in the case of an A4 size ordinary paper, a reduction is accordingly achieved in terms of cleaning web output timing.

TABLE 3

| Rank | Recording material pass detection time | Control | Output timing |
|---|---|---|---|
| Ref | (single sheet) | Ref | per 15 min. |
| A | 50 ~ (Sec) | Ref × 0.9 | per 13.5 min. |
| B | 40 ~ 50 | Ref × 0.8 | per 12 min. |
| C | 30 ~ 40 | Ref × 0.7 | per 10.5 min. |
| D | ~30 | Ref × 0.6 | per 9 min. |

According to Table 2, a sum total of the inter-sheet distances passing in a fixed period of time, i.e., the smaller the recording material detection time becomes larger passing in a fixed period of time, the output timing for the cleaning web 19 becomes shorter, thereby enhancing the cleaning capacity.

The cleaning capacity can be switched according to the sum total of the inter-sheet distances passing in a fixed period time, whereby it is always possible to clean the feeding belt as satisfactorily as or better than in the first embodiment.

THIRD EMBODIMENT

Next, a third embodiment of the present invention will be described with reference to FIG. 2. This embodiment is characterized in that the cleaning capacity of the cleaning web 19 is switched according to the size of the recording material with respect to the direction perpendicular to the feeding direction and the thickness thereof.

While the first and second embodiments have been described mainly from the viewpoint of the inter-sheet distance, the width of the recording material in the direction perpendicular to the direction in which the feeding belt runs is as important a parameter as the inter-sheet distance in determining the contamination of the feeding belt with scattered toner.

That is, if the inter-sheet distance is the same, there is a great difference between A4 sheet and A6 size post card in terms of the area of the exposed surface portion of the feeding belt during which the recording material is being attracted.

Thus, in this embodiment, recording material size data from cassette detection and recording material size data obtained through manual setting by the user are supplied to a processing device and, on the basis of the data thus obtained, the motor of the take-up roller for the cleaning web is controlled. As a result, a satisfactory cleaning is realized with a simple construction.

Apart from the recording material size, data on the thickness of the recording material may be used. For example, a sensor 100 for detecting the thickness of the recording material as shown in FIG. 2 may be provided, and data thereby obtained may be processed together with the data on the recording material size, whereby it is possible to perform cleaning in a more satisfactory manner.

Figure 2:
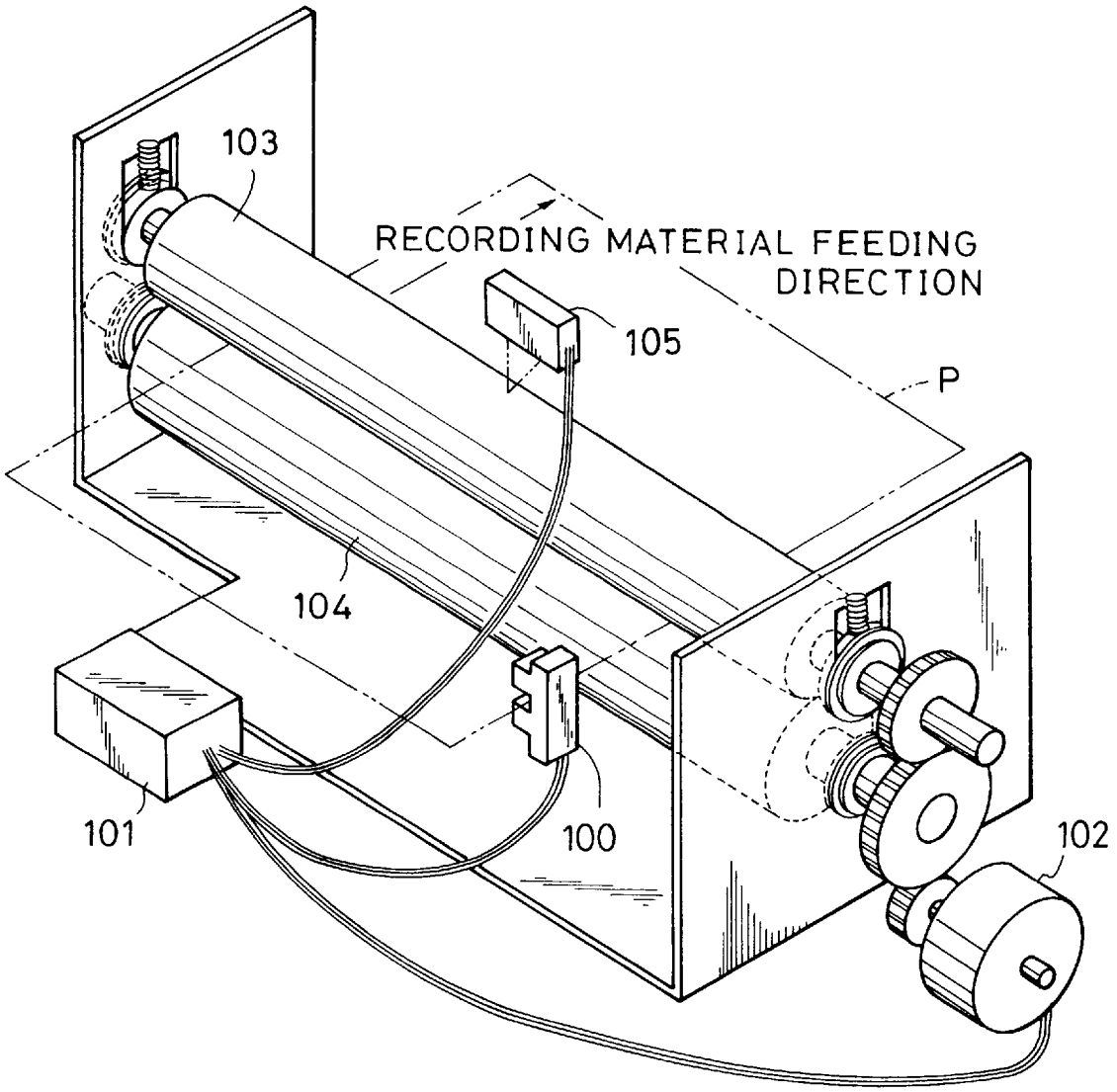
FIG. 2 is a schematic diagram showing the construction of a recording material thickness detecting sensor.

With reference to FIG. 2, the manner in which the thickness of the recording material is detected by the sensor will be described.

When the forward end of the recording material 20, conveyed from the upstream side, reaches the transmission type photo sensor 100, light applied to the sensor 100 is intercepted and the output of the sensor 100 changes, whereby the reaching of the recording material is detected. At the same time, a CPU 101 drives a drive source 102, whereby a pair or rollers consisting of a feeding roller 103 and a pressurizing roller 104 start to rotate at a circumferential speed that is the same as the speed at which the recording material 20 is fed. When the forward end of the recording material reaches the pair of rollers 103 and 104, the recording material is held between the pair of rollers 103 and 104 and is further conveyed. When the recording material is held between these rollers, the center distance between the pair of rollers increases by an amount corresponding to the thickness of the recording material. This increase is detected by a thickness sensor 105.

Regarding the thickness of the recording material, it is not always necessary to detect it by a sensor. The user may input information on the thickness of the recording material to the device. In accordance with the thickness of the recording material, the fixing speed is changed and the inter-sheet distance is changed.

As described above, due to the two items of data supplied to the processing device, i.e., the data on the recording material size and the data on the recording material thickness, parameters regarding the scattered toner and fog toner on the feeding belt, such as CPM (copies/minutes) and inter-sheet distance, are clarified, and the above-mentioned processing device can output an optimum value for cleaning capacity switching.

FOURTH EMBODIMENT

While the above embodiments have only been described with reference to the case in which, in a sheet-type cleaning member such as a cleaning web, the switching of cleaning capacity is effected by changing the output timing for taking up the cleaning web, it is also possible to vary the speed at which the cleaning web is taken up. Further, it is also possible to use a fur brush instead of the sheet-type cleaning member. As compared with the case in which the cleaning capacity is maintained by constant rotation at high speed, the progress of wear of the fur brush is restrained to an utmost degree while performing cleaning satisfactorily by changing to an appropriate rotating speed, thus achieving an increase in the service life of the cleaning device. Further, the wear of the surface of the feeding belt due to the fur belt can be reduced. Further, the cleaning member may be a cleaning roller formed by winding a non-woven fabric around a roller, and the cleaning capacity may be varied by varying the rotating speed thereof.

Figure 4:
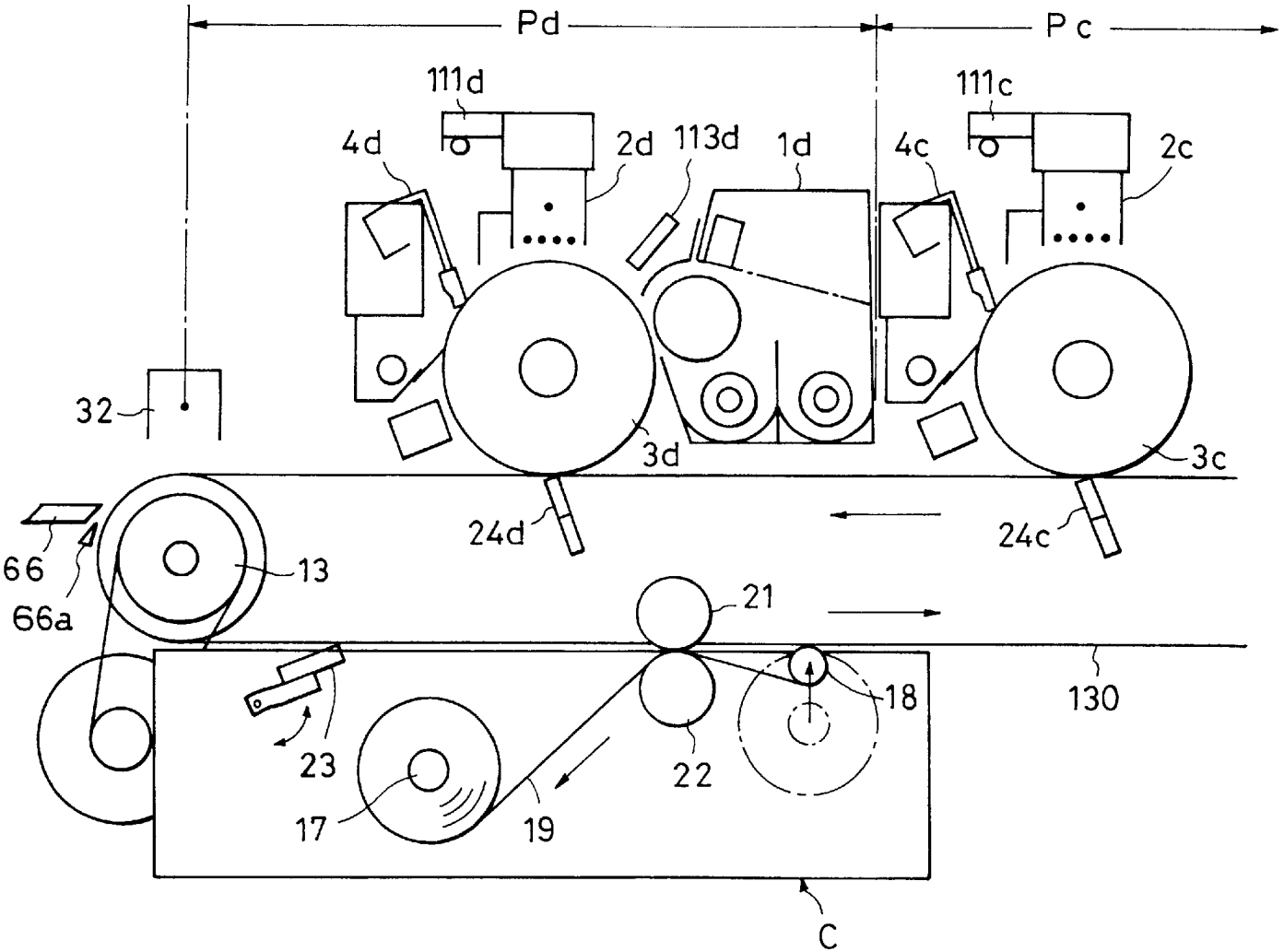
FIG. 4 is a schematic diagram showing the construction of another example of a feeding belt cleaning unit.
Figure 5:
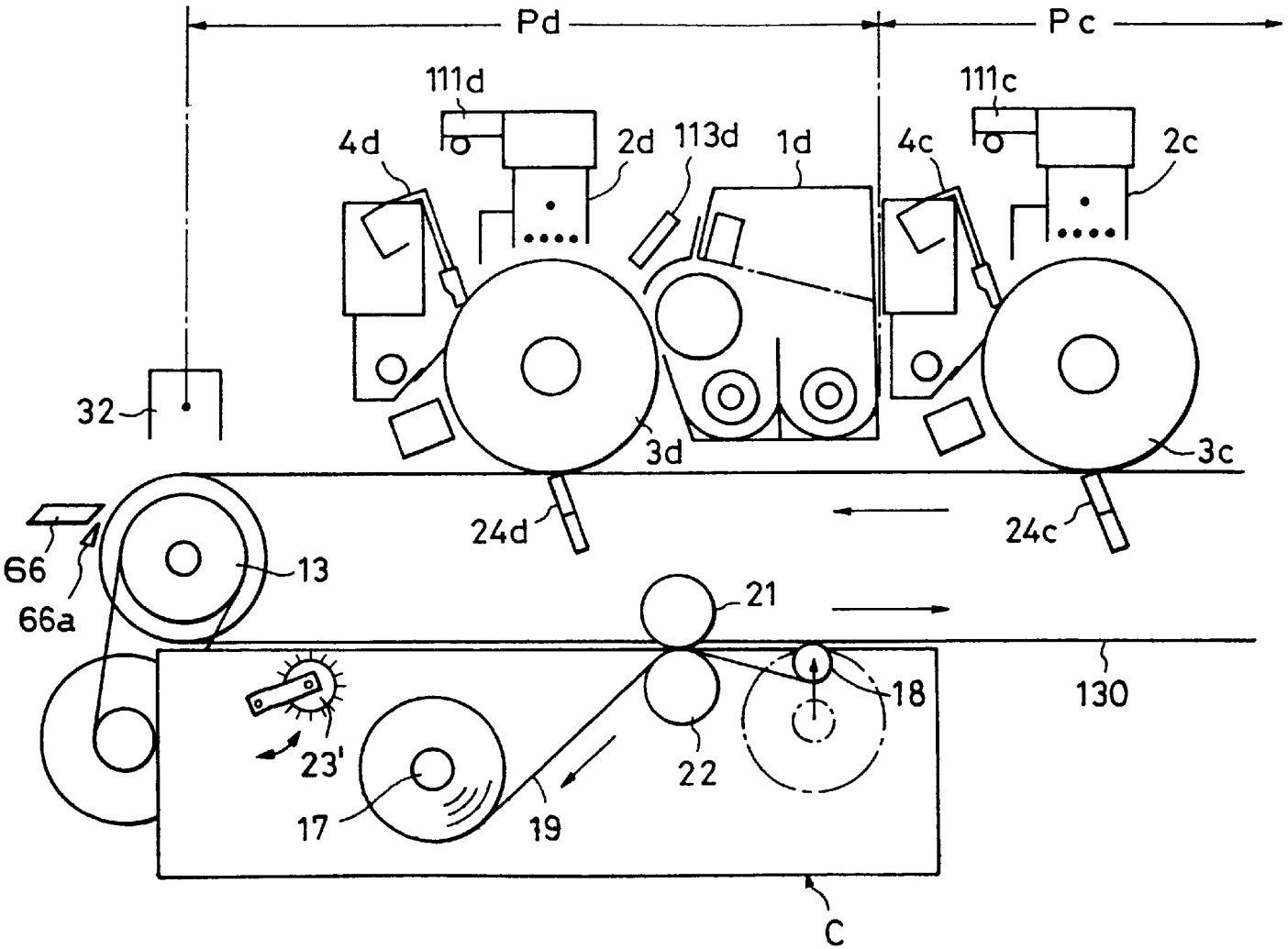
FIG. 5 is a schematic diagram showing the construction of yet another example of a feeding belt cleaning unit.

Further, as shown in FIGS. 4 and 5, in addition to the sheet-type cleaning member, either a plate-type or a brush-type cleaning member, for example, a cleaning blade 23 or a fur brush 23' may be provided, and the above-described switching of cleaning capacity may be effected through contact or separation of the blade or the brush with or from the feeding belt, thereby cleaning the surface of the feeding belt in a satisfactory manner.

Further, it goes without saying that the same effect can be obtained by an appropriate combination of the above-described control operations and members to vary the cleaning capacity.

In the first through third embodiments, the output timing for the cleaning member is varied so as to vary the cleaning capacity. In some cases, a plurality of ranks of recording materials as shown in the first and second embodiments are used between one output and the next output of the cleaning member. Taking this into consideration, it is desirable, as shown in FIG. 4, to vary the rotating speed of the cleaning member according to the inter-sheet distance and the size of the recording material. That is, it may be arranged such that, the larger the inter-sheet distance, or the smaller the size of the recording material, the higher the rotating speed of the cleaning member.

What is claimed is:

1. An image forming apparatus comprising:

an image carrying member for carrying an image;

a recording material carrying member for carrying a recording material;

transfer means for transferring the image from said image carrying member to the recording material carried by said recording material carrying member;

cleaning means for cleaning said recording material carrying member, wherein said cleaning means includes a cleaning member and an auxiliary cleaning member, which are capable of contacting said recording material carrying member during cleaning of said recording material carrying member; and determining means for determining the distance between a rear end of recording material and a forward end of a next recording material when images are formed successively on a plurality of recording materials;

wherein, said auxiliary cleaning member is used selectively in order to vary a cleaning capacity of said cleaning means in accordance with the distance determined by said determining means.

2. An image forming apparatus according to claim 1, further comprising fixing means for fixing the image on the recording material, wherein a plurality of fixing speeds of said fixing means is selectable, and said distance being different in accordance with the selected fixing speed.

3. An image forming apparatus according to claim 1 or 2, wherein said apparatus allows, after the formation of an image on a first surface of a recording material, the formation of an image on a second surface of the recording material, and wherein said distance differs in accordance with whether image formation is effected on the first surface of the recording material or the second surface thereof.

4. An image forming apparatus according to claim 1 or 2, wherein said distance differs in accordance with whether the recording material is an ordinary paper or an OHP film.

5. An image forming apparatus according to claim 1 or 2, wherein said distance differs in accordance with whether the recording material is an ordinary paper or a paper having a thickness larger than that of the ordinary paper.

6. An image forming apparatus according to claim 1, wherein the timing of movement of said cleaning member is varied in order to vary the cleaning capacity.

7. An image forming apparatus according to claim 1, wherein the moving speed of said cleaning member is varied in order to vary the cleaning capacity.

8. An image forming apparatus according to claim 6 or 7, wherein said cleaning member consists of a web.

9. An image forming apparatus according to claim 1, wherein said auxiliary cleaning member is in the form of a plate.

10. An image forming apparatus according to claim 1, wherein the cleaning capacity of said cleaning means is larger as the length of the recording material in the direction perpendicular to a conveying direction of said recording material becomes smaller.

11. An image forming apparatus according to claim 1, wherein said auxiliary cleaning member comprises a brush.

12. An image forming apparatus comprising:

an image carrying member for carrying an image;

a recording material carrying member for carrying a recording material;

transfer means for transferring the image from said image carrying member to the recording material carried by said recording material carrying member;

cleaning means for cleaning said recording material carrying member, wherein said cleaning means comprises a cleaning member and an auxiliary cleaning member, which are capable of contacting said recording material carrying member during cleaning of said carrying member, and wherein, when images are formed successively on a plurality of recording materials, said auxiliary cleaning member is used selectively in order to vary a cleaning capacity of said cleaning means in accordance with a length of a recording material in a direction perpendicular to a conveying direction of the recording material.

13. An image forming apparatus according to claim 12, wherein wherein the timing of movement for said cleaning member is varied in order to vary the cleaning capacity.

14. An image forming apparatus according to claim 12, wherein the moving speed of said cleaning member is varied in order to vary the cleaning capacity.

15. An image forming apparatus according to claim 13 or 14, wherein said cleaning member consists of a web.

16. An image forming apparatus according to claim 12, wherein said auxiliary cleaning member is in the form of a plate.

17. An image forming apparatus according to claim 12, wherein said auxiliary cleaning member comprises a brush.

* * * * *

UNITED STATES PATENT AND TRADEMARK OFFICE

CERTIFICATE OF CORRECTION

PATENT NO. : 5,983,050

DATED : November 9, 1999

INVENTOR(S) : Rie TAKEKOSHI, et al.

It is certified that error appears in the above-identified patent and that said Letters Patent is hereby corrected as shown below:

COLUMN 3:

Line 14, "apparatus; and" should read --apparatus;--.
Line 16, "unit." should read --unit; and--.

COLUMN 5:

Line 13, "an" should read --a--.

COLUMN 6:

Line 1, "the" should read --that the--.

COLUMN 7:

Line 38, "distance" (second occurrence) should read --distance between--.
Line 40, "belt" should read --belt,--.
Line 66, "ordinarily" should read --ordinary--.

COLUMN 8:

Line 57, "un-fixed" should read --unfixed--.

UNITED STATES PATENT AND TRADEMARK OFFICE

CERTIFICATE OF CORRECTION

PATENT NO. : 5,983,050

DATED : November 9, 1999

INVENTOR(S) : Rie TAKEKOSHI, et al.

It is certified that error appears in the above-identified patent and that said Letters Patent is hereby corrected as shown below:

COLUMN 9:

Line 40, "time;" should read --time becomes larger,--.
Line 41, "time becomes larger" should read --time--.

COLUMN 10:

Line 27, "or" should read --of--.

COLUMN 12:

Line 34, "member;" should read --member; and--.
Line 49, "wherein wherein" should read --wherein--.

Signed and Sealed this

Twenty-first Day of November, 2000

*Attest:*

Q. TODD DICKINSON

*Attesting Officer*

*Director of Patents and Trademarks*